US006072169A

United States Patent [19]

Kang et al.

[11] Patent Number: 6,072,169

[45] Date of Patent: Jun. 6, 2000

[54] WALL MOUNTED MICROWAVE OVEN AND CONTROL METHOD THEREFOR

[75] Inventors: Jeon Hong Kang; Sang Hun Baek, both of Kyungki-do, Rep. of Korea

[73] Assignee: Samsung Electronics Co., Ltd., Suwon, Rep. of Korea

[21] Appl. No.: 09/266,757

[22] Filed: Mar. 12, 1999

[30] Foreign Application Priority Data

Jul. 29, 1998 [KR] Rep. of Korea ..... 98-30665

[51] Int. Cl.[7] ..... H05B 6/68; H05B 6/80

[52] U.S. Cl. ..... 219/702; 219/718; 219/757; 219/710; 126/273 A; 126/299 D

[58] Field of Search ..... 219/702, 710, 219/716, 718, 721, 757, 758; 126/21 A, 273 A, 299 R, 299 D

[56] References Cited

U.S. PATENT DOCUMENTS

| | | | |
|---|---|---|---|
| 4,143,646 | 3/1979 | Sampsel | 126/299 D |
| 4,198,553 | 4/1980 | Dills | 219/718 |
| 4,591,683 | 5/1986 | Eke | 219/757 |
| 4,853,501 | 8/1989 | Sang et al. | 200/38 FA |
| 4,886,046 | 12/1989 | Welch | 219/757 |
| 5,171,949 | 12/1992 | Fujishima et al. | 219/716 |

*Primary Examiner*—Philip H. Leung
*Attorney, Agent, or Firm*—Burns, Doane, Swecker & Mathis, L.L.P.

[57] ABSTRACT

A wall mounted microwave oven is provided which includes a body forming therein a cavity for accommodating food to be cooked, a magnetron for generating electromagnetic waves to be provided into the cavity, a casing surrounding the body and forming therein a hood duct having an inlet port positioned at the bottom portion of the casing and an outlet port positioned in the upper portion thereof, and a hood fan installed in the hood duct. The wall mounted microwave oven includes a hood sensor for sensing a status that operation of saidhood fan is needed; a first switch for selectively supplying one out of a low-level voltage and a normal voltage to the magnetron, and a controller for controlling the hood fan to operate if a detect signal informing operation of said hood fan is needed is input from the hood sensor and simultaneously controlling the first switch to change the electric power to be supplied to the magnetron from the normal voltage into the low-level voltage. Accordingly, the microwave oven can control operation of a hood fan based on a detect signal sensed by a hood sensor and simultaneously lower an electric power voltage level to be supplied to a magnetron, thereby effectively preventing an overload from being applied to the microwave oven.

5 Claims, 4 Drawing Sheets

WALL MOUNTED MICROWAVE OVEN AND CONTROL METHOD THEREFOR

BACKGROUND OF THE INVENTION

1. Field of the Invention

The present invention relates to a wall mounted microwave oven and a control method therefor, more particularly, to a wall mounted microwave oven comprising a body forming therein a cavity for accommodating food to be cooked, a magnetron for generating electromagnetic waves to be provided into the cavity, a casing surrounding the body and forming therein a hood duct having an inlet port positioned at the bottom portion of the casing and an outlet port positioned in the upper portion thereof, and a hood fan installed in the hood duct and a control method therefor.

2. Description of the Related Art

As shown in FIG. 1, a wall mounted microwave oven is mounted on a wall above a gas range 50, and has a function of inhaling vapor and fumes generated when food are cooked in the gas range 50 and exhaling them, in order for the microwave oven to serve as a hood. As shown in FIGS. 1 and 2, the wall mounted microwave oven is comprised of a body 3 having a cavity 4 in which the food are accommodated, and a casing 6 surrounding the body 3. A magnetron 30 which supplies electromagnetic waves into the cavity 4 is mounted in the body 3. The magnetron 30 receives a high-tension current via a high-voltage transformer (not shown) and a high-voltage capacitor (not shown).

Meanwhile, the casing 6 includes an upper casing 6*a* surrounding the upper portion and both the side surfaces of the body 3 and a lower casing 6*b* combined with the lower portion of the body 3. Hood duct 15 as a path for exhausting vapor and fumes is formed in the space between the casing 6 and the body 3. To do so, an inlet port 8 for inhaling vapor and fumes into the hood duct 15 is formed on the lower casing 6*b* and an outlet port 9 is formed on the upper surface of the upper casing 6*a*. An exhaust pipe 11 is connected with the outlet port 9. The exhaust pipe 11 is connected with an exhaust path 17 penetrating the wall and communicating with the air. A hood fan 13 is installed in the upper portion of the body 3 in the vicinity of the outlet port 9, in order to exhaust the vapor and fumes inhaled into the hood duct 15 via the inlet port 8 to the air via the outlet port 9. Meanwhile, a hood lamp 55 for illuminating the gas range 50 is installed on the bottom of the lower casing 6*b*.

Meanwhile, a user can choose from various select buttons provided on an operation control panel, so that the hood fan 13 is activated or deactivated. As being the case, a hood sensor is provided in the inlet port 8 or the inner portion of the hood duct 15, thereby generating, e. g. a heat detect signal as a control signal so as to supply electric power to the hood fan 13 or isolate the hood fan 13 from the electric power, according to a temperature of ambient air. The hood sensor is generally formed of a bimetal and turned on if the ambient temperature is above a predetermined temperature. The hood sensor is interposed between a hood fan motor 45 and an electrical power source, and generates a control signal for connecting and disconnecting the power source to and from the hood fan motor 45, respectively, according to whether to detect heat or not.

In the case that the magnetron 30 having a consumption power of above 1 KW and the hood lamp 55 having a consumption power of 80 W, or the magnetron 30 having a consumption power of above 1 KW and the hood fan 13 having a consumption power of 150 W–200 W operate simultaneously, a fuse in a distribution panel is melted and thus electrical power is cut off, because the microwave oven may have been overloaded.

Accordingly, the wall mounted microwave oven can choose the electric power to be supplied for the magnetron 30 to a voltage lower than a normal voltage in order to prevent the microwave oven from being overloaded or accept a user's selection.

However, for a conventional wall mounted microwave oven, the controller 10 doesn't know when hood fan 13 is operated without controller 10's instruction according to the hood sensor formed of a bimetal. Thus, the controller 10 cannot control a voltage level for the magnetron 30 in the event that the hood fan 13 operated by the hood sensor formed of a bimetal and the problem of the overload cannot be effectively solved at that time.

SUMMARY OF THE INVENTION

To solve the above problems, it is an object of the present invention to provide a wall mounted microwave oven which can prevent an overload from being applied thereto by lowering an electric power voltage for a magnetron, in the case that a hood fan and a magnetron are operated simultaneously, and a control method therefor.

It is another object of the present invention to provide a wall mounted microwave oven which can prevent an overload from being applied thereto by driving a hood fan at low speed, in the case that a hood fan and a magnetron are operated simultaneously, and a control method therefor.

To accomplish the above object of the present invention, there is provided a wall mounted microwave oven comprising a body forming therein a cavity for accommodating food to be cooked, a magnetron for generating electromagnetic waves to be provided into the cavity, a casing surrounding the body and forming therein a hood duct having an inlet port positioned at the bottom portion of the casing and an outlet port positioned in the upper portion thereof, and a hood fan installed in the hood duct, the wall mounted microwave oven comprising: a hood sensor for sensing a status that operation of said hood fan is needed; a first switch for selectively supplying one out of a low-level voltage and a normal voltage to the magnetron; and a controller for controlling the hood fan, to operate if a signal informing that operation of said hood fan is needed is inputted from the hood sensor, and simultaneously controlling the first switch to change the electric power to be supplied to the magnetron from the normal voltage into the low-level voltage.

Here, it is preferable that the controller controls the first switch to change the electric power for the magnetron from the low-level voltage into the normal voltage, in the case that the signal informing that operation of said hood fan is needed is not supplied from the hood sensor.

The wall mounted microwave oven also further comprises a second switch for selecting the rotational speed of the hood fan to operate at either a comparatively high speed or a comparatively low speed. It is preferable that the controller controls the second switch to operate the hood fan at the low speed when the hood fan and the magnetron are operated simultaneously.

Meanwhile, there is also provided a control method for controlling a wall mounted microwave oven comprising a body forming therein a cavity for accommodating food to be cooked, a magnetron for generating electromagnetic waves to be provided into the cavity, a casing surrounding the body and forming therein a hood duct having an inlet port positioned at the bottom portion of the casing and an outlet port in the upper portion thereof, and a hood fan installed in the hood duct, the wall mounted microwave oven control method comprising the steps of: detecting a status that operation of said hood fan is needed; and supplying a normal voltage to the magnetron when a signal informing operation of said hood fan is not detected, and supplying a low-level voltage lower than the normal voltage to the magnetron at the same time when operating the hood fan when the signal informing operation of said hood fan is detected.

Here, it is preferable that the hood fan is operated at a comparatively high speed during deenergization of the magnetron and at a comparatively low speed during energization of the magnetron.

BRIEF DESCRIPTION OF THE DRAWINGS

The above objects and advantages of the present invention will be apparent by describing the structure and operation thereof in detail with reference to the attached drawings in which.

DETAILED DESCRIPTION OF THE INVENTION

A preferred embodiment of the present invention will be described in detail with reference to the accompanying drawings.

Figure 1:
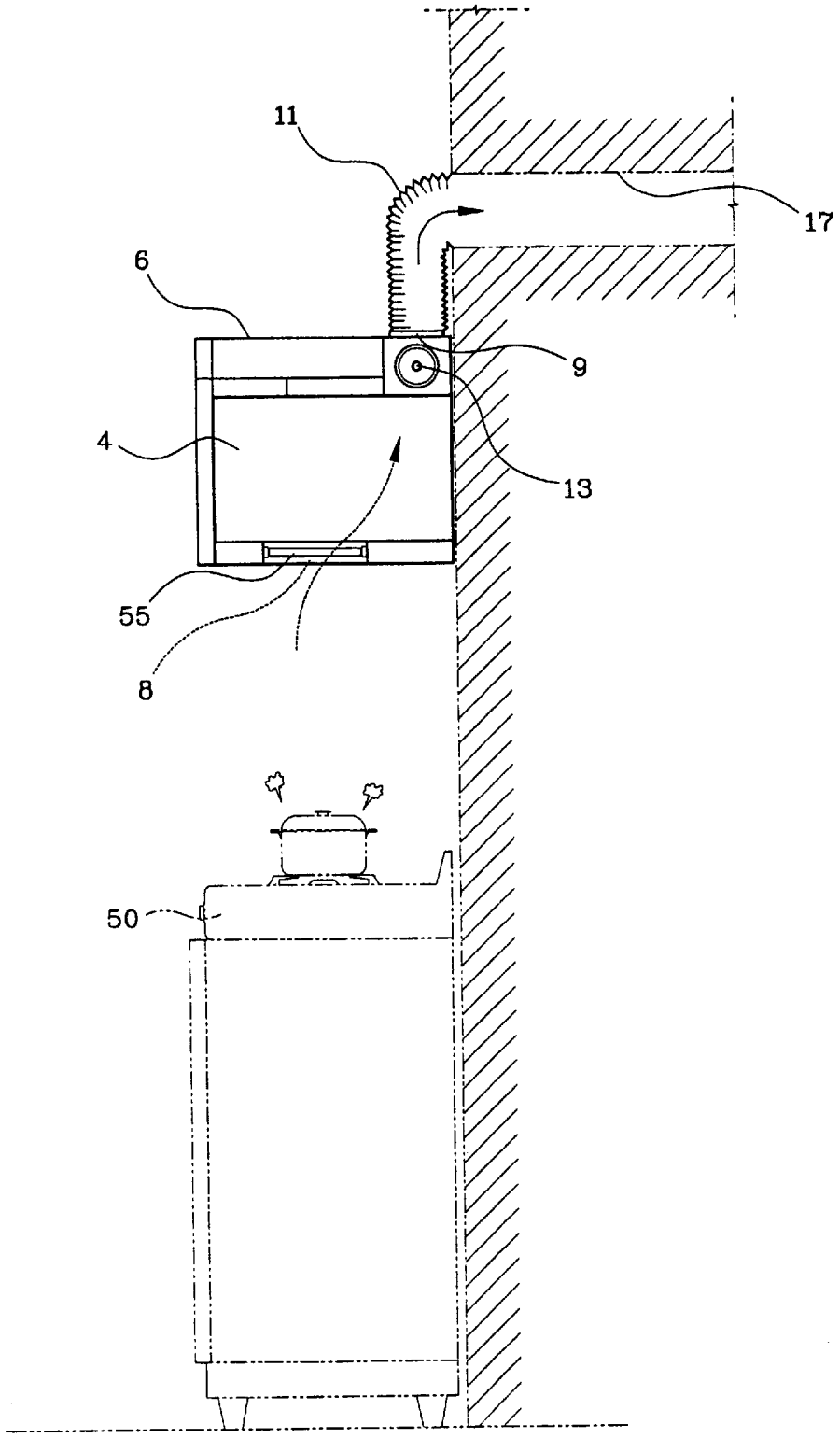
FIG. 1 is a schematic view showing a configuration of a wall mounted microwave oven according to the present invention when it has been installed on a wall.
Figure 2:
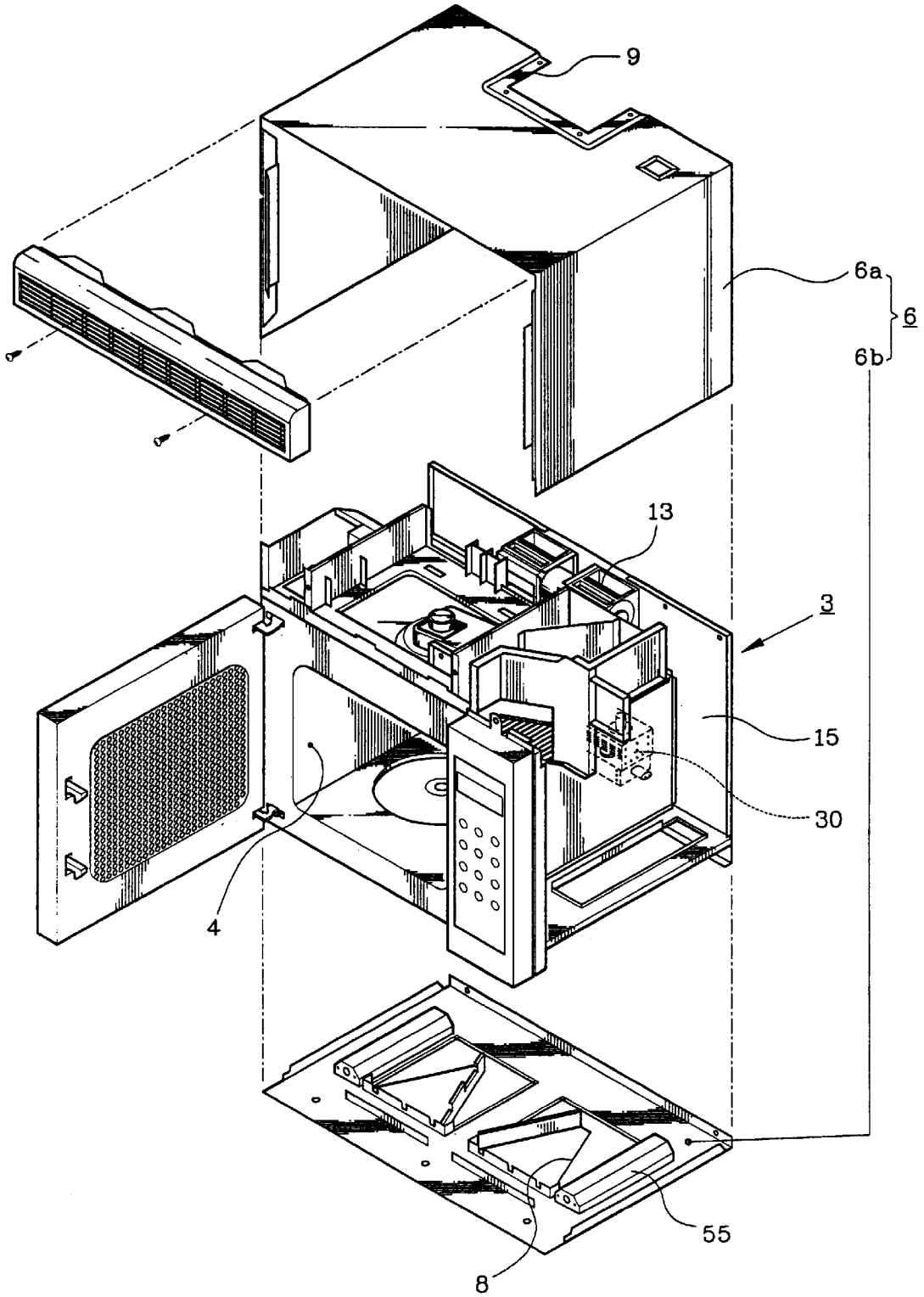
FIG. 2 is a partially exploded perspective view showing a wall mounted microwave oven according to the present invention.

A wall mounted microwave oven according to the present inventon has the same configuration as that shown in FIGS. 1 and 2, the detailed descripton of the structure of the present invention will be omitted herein.

Figure 3:
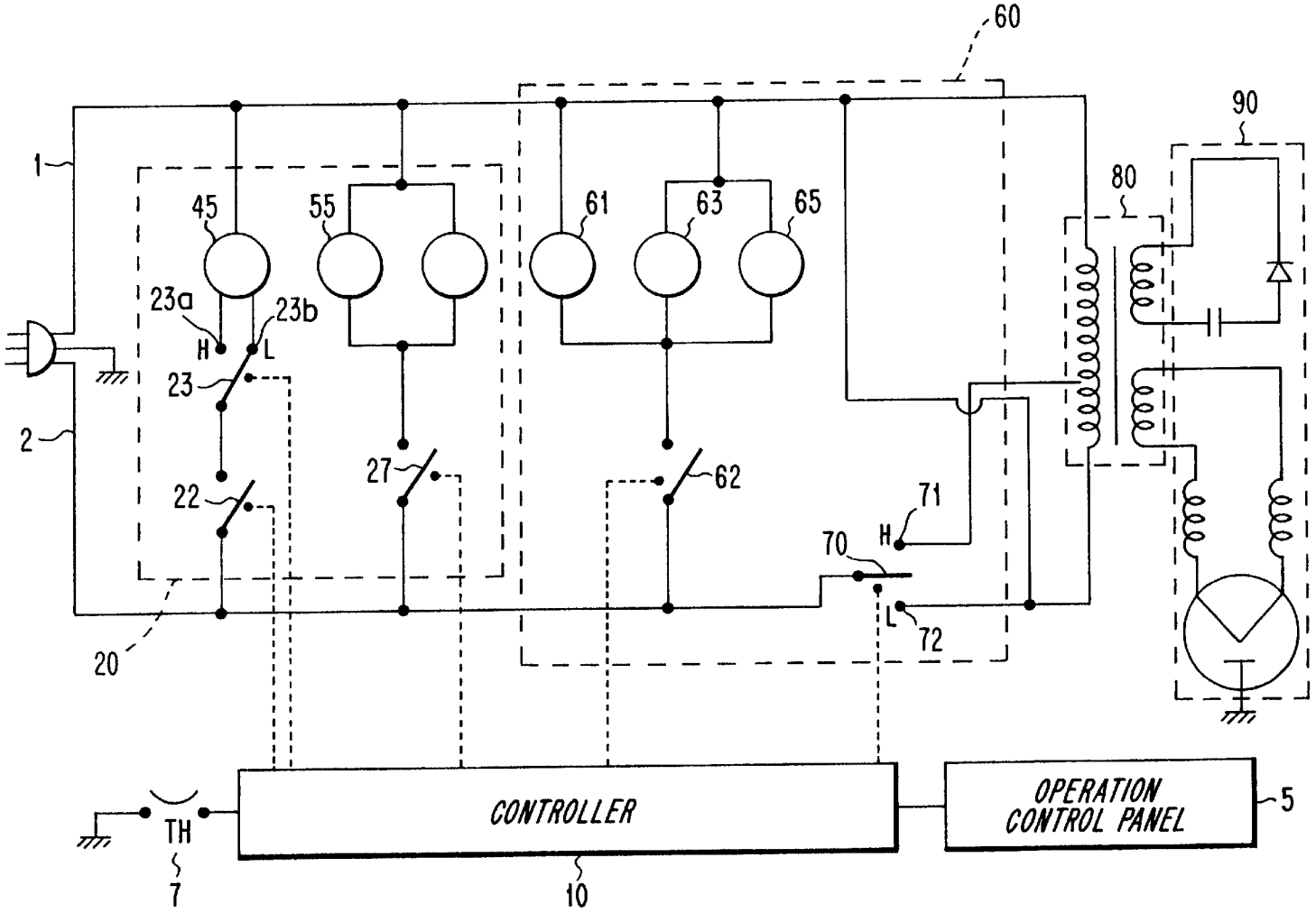
FIG. 3 is a circuitry diagram of a wall mounted microwave oven according to the present invention.

FIG. 3 is a circuitry diagram of a wall mounted microwave oven according to the present invention. As shown in FIG. 3, a driving circuit for a wall mounted microwave oven is comprised of a hood driving portion 20 coupled between first and second commercial power supply lines 1 and 2, and a microwave oven circuit portion 60 connected in parallel with the hood drive 20, for controlling electric power for a magnetron driving circuit portion 90 to be supplied via a high-voltage transformer 80.

The microwave circuit portion 60 includes a cooking chamber electric lamp 61 and a cooking chamber switch 62 formed between the first and second commercial power supply lines 1 and 2, and a stirrer motor 63 and an air blowing electric fan motor 65 connected in parallel with each other between the first commercial power supply line 1 and an electric line which connects the cooking chamber electric lamp 61 and the cooking chamber switch 62. Meanwhile, a first switch 70 for selecting the level of a voltage to be supplied to a high-voltage transformer 80 for energizing the magnetron 30 is connected between the second commercial power supply line 2 and the induction coil of the high-voltage transformer 80, and is formed of a normal voltage contact 71 which is turned on when high electric power is output, and a low-level voltage contact 72 which is turned on when low electric power is output. Here, the normal voltage contact 71 is connected with an intermediate tap on the induction coil and the low-level voltage contact 72 is connected with one end of the induction coil.

Meanwhile, the hood driving portion 20 includes a hood lamp 55 connected between the first and second commercial power supply lines 1 and 2 and a hood lamp switch 27 for supplying electric power to the hood lamp 55 or isolating it therefrom. The hood driving portion 20 also includes a hood fan motor 45 connected between the first and second commercial power supply lines 1 and 2, connected in parallel with the hood lamp 55 and the hood lamp switch 27, a hood fan switch 22 for supplying electric power to the hood fan motor 45 or isolating it therefrom, and a second switch 23 for selecting the driving speed of the hood fan motor 45 to operate at either high speed or at low speed. The second switch 23 is turned on toward a high speed contact 23*a* or a low speed contact 23*b* under control of a controller 10.

A hood sensor 7 for detecting heat or fumes, e. g. generated from a gas range of FIG. 1 and providing a detect signal informing operation of said hood fan motor 45 is needed is also connected with the controller 10. If a heat or fume detect signal is input from the hood sensor 7, the controller 10 turns on the hood fan switch 22 at high speed or at low speed, to then supply electric power to the hood fan motor 45.

Figure 4:
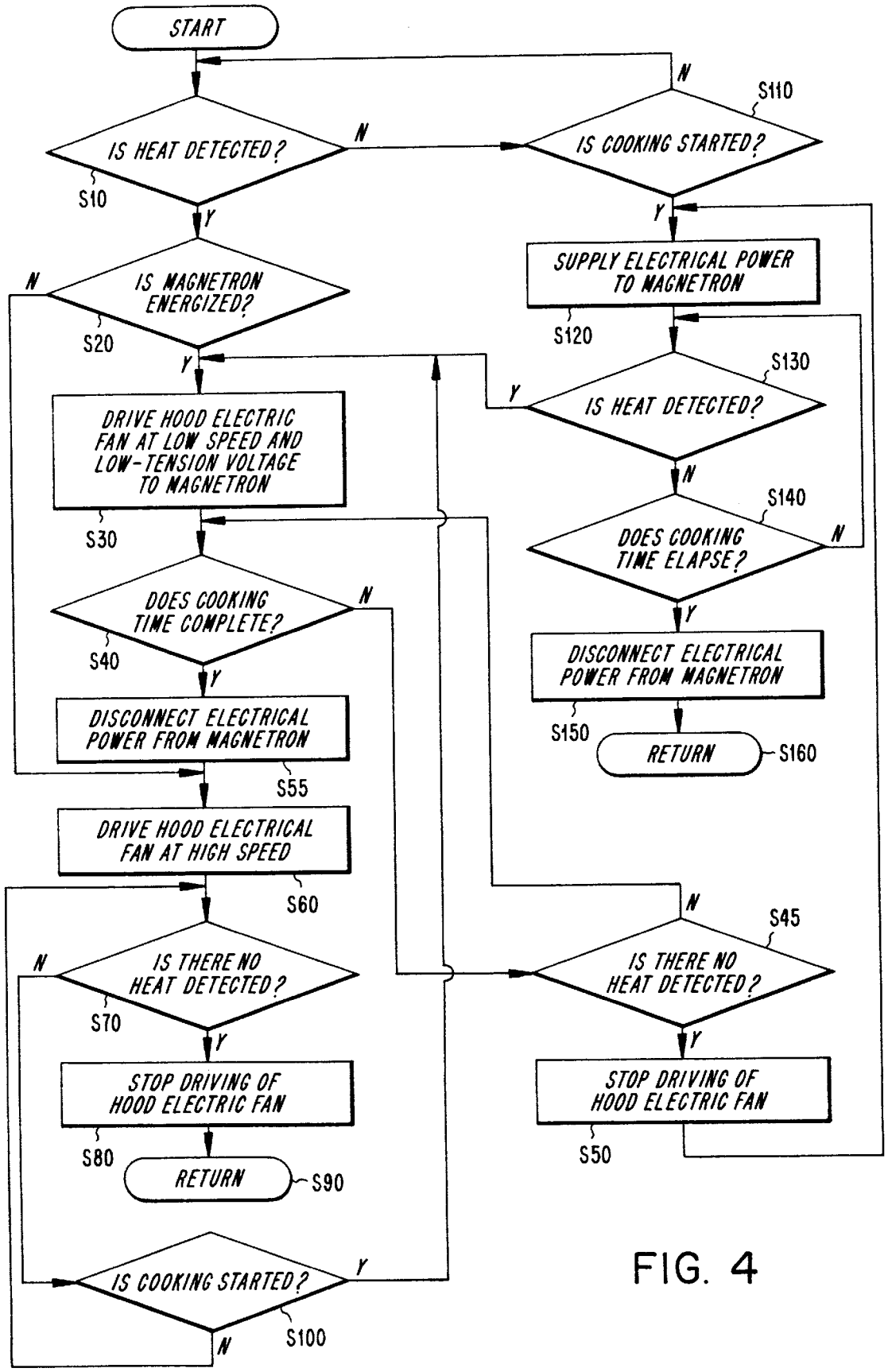
FIG. 4 is a flow chart for explaining a method for controlling the wall mounted microwave oven of FIG. 3.

FIG. 4 is a flow chart illustrating a controlling process of the controller 10. If power is applied to the wall mounted microwave oven, the controller 10 judges whether heat or fumes is detected by the hood sensor 7 (S10). If a heat or fume detect signal is input from the hood sensor 7, the controller 10 confirms whether or not the magnetron 30 is energized (S20). Here, if it is judged that the magnetron 30 is energized, the controller 10 turns on the low speed control 23b of the second switch 23, in order to drive the hood fan 13 at low speed, and turns on the low-level voltage contact 72 of the first switch 70 in order to supply a low-level voltage to the magnetron 30 (S30). When the magnetron 30 is not energized (S20), the hood fan 13 is driven at high speed (S60). Then, it is judged whether a corresponding cooking time elapses (S40). If the corresponding cooking time has elapsed, electric power is not supplied to the magnetron 30 (S55). At the same time, the second switch 23 is changed over from the low speed contact 23*b* to the high speed contact 23*a*, in order to drive the hood fan 13 at high speed (S60). Meanwhile, if the cooking continues (S40), it is judged whether heat is continuously detected (S45). If heat or fumes is continuously detected in step S45, the program returns to the step S40 for judging whether a cooking time completes. If heat stops to be detected in step S45, the driving of the hood fan 13 stops (S50), and the normal voltage is simultaneously supplied to the magnetron 30 (S120).

If the hood fan 13 operates at high speed in step S60, it is confirmed whether heat or fumes is continuously detected (S70). If heat or fumes is not detected any more in step S70, the hood fan 13 is controlled to stop (S80) and the program returns to the initial state (S90). Meanwhile, if heat is continuously detected in step S70, it is confirmed whether a new cooking is started (S100). If any new cooking is not started in step S100, the program returns to step S70 for confirming whether heat or fumes is continuously detected. If a cooking is performed in step SIOO, the hood fan 12 is A driven at low speed, and then the program proceeds to step S30 for supplying a low-level voltage to the magnetron 30.

Meanwhile, in the case that heat or fumes is not detected by the hood sensor 7 in step S10, the controller 10 confirms whether a cooking is performed (S110). If a cooking is performed in step S110, the normal voltage contact 71 of the first switch 70 is turned on, to supply a normal voltage to the magnetron 30 (S120). Then, if a heat or fume detect signal is input from the hood sensor 7, the program proceeds to step S30, to operate the hood fan 13 at low speed and to supply a low-level voltage to the magnetron 30. If there is no heat or fumes detect signal in step S130, the controller 10 judges whether a cooking time elapses (S140). If the cooking completes, the electric power for the magnetron 30 is disconnected (S150), and then the program returns to the initial state (S160).

By the above construction, the controller 10 controls the hood fan motor 45 to be driven at low speed according to the detect signal of the hood sensor 7*a* informing operation of said hood fan 13 is needed, when the hood fan 13 and the magnetron 30 operate simultaneously. At the same time, the controller 10 controls the low-level voltage lower then the normal voltage to be supplied to the magnetron 30, thereby preventing the microwave oven from being overloaded. In the case that only the hood fan motor 45 operates, the hood fan motor 45 is controlled to operate at high speed, to increase an exhaust efficiency. When only the magnetron 30 operates, the normal voltage is supplied to the magnetron 30, the thereby shorten the cooking time.

As described above, the microwave oven according to the present invention can control operation of a hood fan based on a detect signal sensed by a hood sensor and simultaneously lower an electric power voltage level to be supplied to a magnetron, thereby effectively preventing an overload from being applied to the microwave oven.

What is claimed is:

1. A wall mounted microwave oven comprising a body forming therein a cavity for accommodating food to be cooked, a magnetron for generating electromagnetic waves to be provided into the cavity, a casing surrounding the body and forming therein a hood duct having an inlet port positioned at the bottom portion of the casing and an outlet port positioned in the upper portion thereof, and a hood fan installed in the hood duct, the wall mounted microwave oven comprising:

a hood sensor for sensing a status that operation of said hood fan is needed;

a first switch for selectively supplying one out of a low-level voltage and a normal voltage to the magnetron; and a controller for controlling the hood fan to operate if a signal informing that operation of said hood fan is needed is input from the hood sensor and simultaneously controlling the first switch to change the electric power supplied to the magnetron from the normal voltage into the low-level voltage.

2. The wall mounted microwave oven according to claim 1, wherein said controller controls the first switch to change the electric power voltage to be supplied to the magnetron from the low-level voltage into the normal voltage, in the case that the sensed signal informing that operation of said hood fan is needed is not supplied from the hood sensor.

3. The wall mounted microwave oven according to claim 1, further comprising a second switch for selecting the rotational speed of the hood fan to operate at either a comparatively high speed or at a comparatively low speed, and wherein said controller controls the second switch to operate the hood fan at the low speed when the hood fan and the magnetron are operated simultaneously.

4. A control method for controlling a wall mounted microwave oven comprising a body forming therein a cavity for accommodating food to be cooked, a magnetron for generating electromagnetic waves to be provided into the cavity, a casing surrounding the body and forming therein a hood duct having an inlet port positioned at the bottom portion of the casing and an outlet port positioned in the upper portion thereof, and a hood fan installed in the hood duct, the wall mounted microwave oven control method comprising the steps of:

detecting a status informing that operation of said hood fan is needed; and supplying a normal voltage to the magnetron when a signal informing that operation of said hood fan is needed is not detected, and supplying a low-level voltage lower than the normal voltage to the magnetron at the same time when operating the hood fan when the status informing that operation of said hood fan is needed is detected.

5. The control method for controlling a wall mounted microwave oven according to claim 4, wherein said hood fan is operated at a comparatively high speed during deenergization of the magnetron and at a comparatively low speed during energization of the magnetron.

* * * * *